United States Patent [19]

Young

[11] Patent Number: 4,703,611

[45] Date of Patent: Nov. 3, 1987

[54] APPARATUS FOR HANDLING COMPACTIBLE ARTICLES

[76] Inventor: Ronald D. Young, 4287 Garland St., Wheatridge, Colo. 80333

[21] Appl. No.: 794,513

[22] Filed: Nov. 4, 1985

[51] Int. Cl.[4] ..... B65B 63/02

[52] U.S. Cl. ..... 53/529; 100/53; 100/91; 100/249; 100/902

[58] Field of Search ..... 53/438, 529, 436, 447, 53/523, 527, 530; 100/53, 91, 249, 295, 902

[56] References Cited

U.S. PATENT DOCUMENTS

| | | | |
|---|---|---|---|
| 2,813,638 | 11/1957 | Miller | 53/537 X |
| 3,010,665 | 11/1960 | Smith | 100/902 X |
| 3,651,755 | 3/1972 | Gati | 100/249 X |
| 3,694,992 | 10/1972 | Hunt | 53/438 |
| 3,721,060 | 3/1973 | Quinto | 53/527 |
| 3,859,908 | 1/1975 | Karls et al. | 100/53 |
| 3,882,770 | 5/1975 | Bleasdale | 100/53 X |
| 3,935,811 | 2/1976 | Lenz et al. | 100/53 |
| 3,945,314 | 3/1976 | Hennells | 100/53 |
| 4,005,648 | 2/1977 | Edwards | 100/53 |
| 4,092,912 | 6/1978 | Simich | 100/295 X |
| 4,346,653 | 8/1982 | Rodak | 100/249 X |
| 4,424,740 | 1/1984 | Gwathney et al. | 100/53 X |
| 4,483,246 | 11/1984 | Sullivan et al. . | |
| 4,483,248 | 11/1984 | Ostreng . | |
| 4,519,306 | 5/1985 | LaBarge et al. | 100/902 X |
| 4,520,722 | 6/1985 | Goldhammer | 100/53 X |
| 4,620,479 | 11/1986 | Diamond et al. | 53/527 X |

OTHER PUBLICATIONS

Can Pak 50 Cancellator (Brochure), CP Manufacturing Company, National City, Calif.

*Primary Examiner*—Robert L. Spruill
*Assistant Examiner*—Steven P. Weihrough
*Attorney, Agent, or Firm*—Fields, Lewis, Pittenger & Rost

[57] ABSTRACT

Method and apparatus for handling compactible articles, and particularly recyclable articles includes a housing forming a compaction chamber with a bottom door movable between a closed position and an open position and having a feed opening through which articles are passed to be collected in said chamber. A retractable loading chute into which articles are discharged directs the articles into the feed opening when in the open extended position is movable to a retracted position to form wall portion of said chamber closing the feed opening. A first drive has a platen that is moved between extended and retracted positions in said compaction chamber to compress the collected articles in the chamber into a unitary block of mechanically interconnected compacted articles and move the block from the chamber. A second drive connected to the bottom door moves said bottom door between a closed position for compaction and a retracted position for the discharge of said block from said chamber. A removable receptacle disposed below the chamber receives the block discharged from said chamber.

5 Claims, 21 Drawing Figures

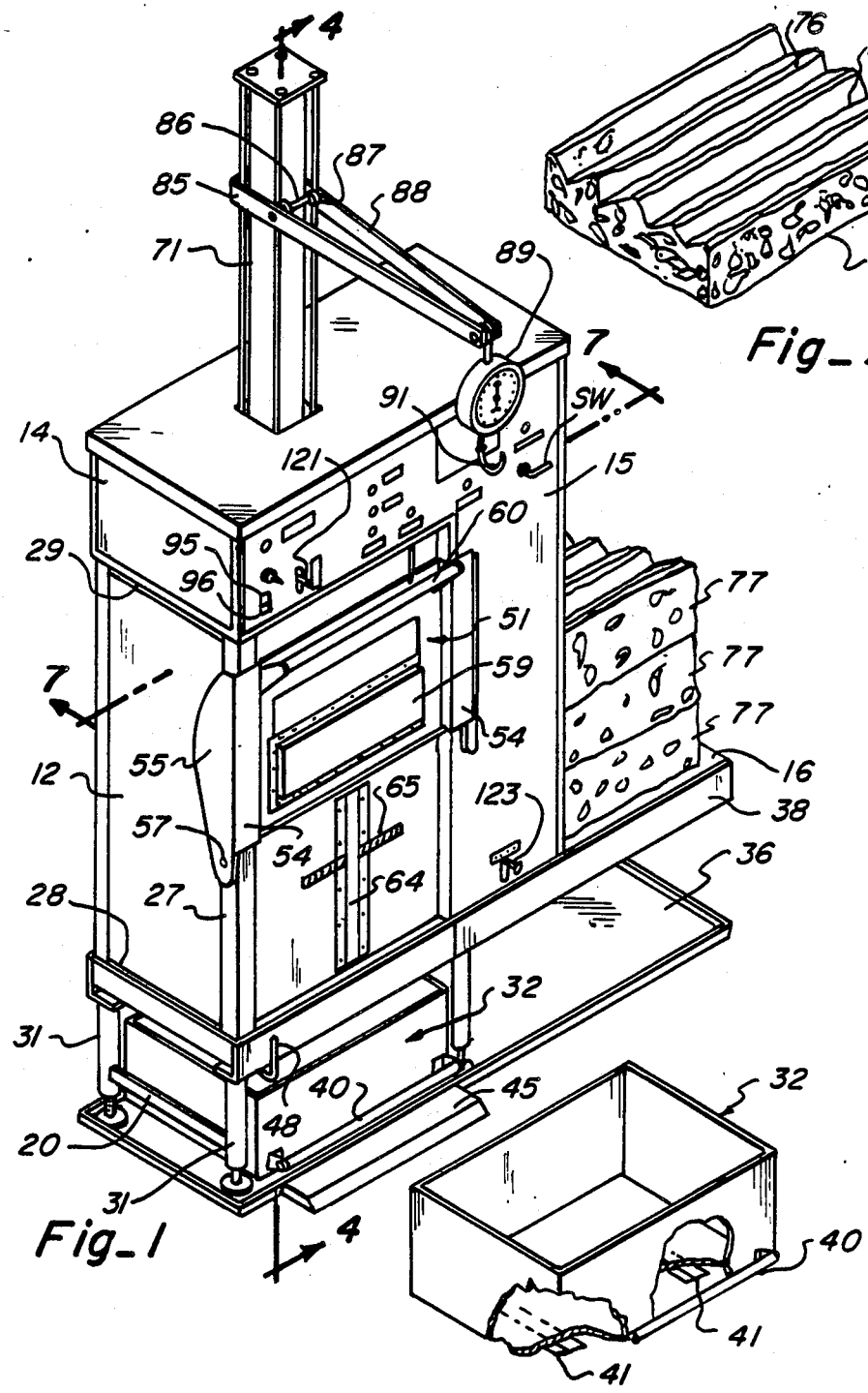
Fig_1
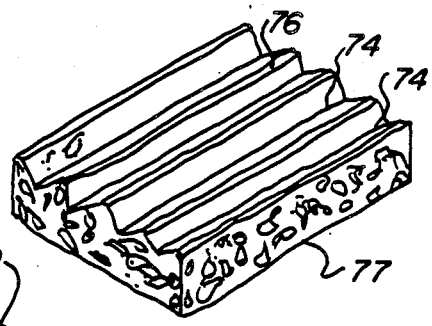
Fig_2
Fig_3

APPARATUS FOR HANDLING COMPACTIBLE ARTICLES

TECHNICAL FIELD

This invention relates to a novel and improved method and apparatus for handling compactible articles, such as recyclable articles that are commonly returned to grocery and convenience stores for the payment of a fee.

BACKGROUND ART

The increasing use of recyclable articles such as aluminum cans, plastic bottles, in grocery and convenience stores, and the payment of a fee for the return of such articles has resulted in large quantities of such articles being returned to the stores. In the past machines have been provided that crush aluminum cans individually and placed in relatively large cardboard boxes or special receptacles. This procedure results in a package of loose articles that takes up considerable space and is difficult to stack and transport.

The Can Pak 50 Cancellator, a product of the CP Manufacturing Company of National City, Calif. is an example of a machine presently in use by grocery and convenience stores and the like. This machine uses a hopper and conveyor that delivers cans and glass to a crusher.

U.S. Pat. No. 4,483,248 discloses a machine into which aluminum cans are fed one at a time into the machine and a relatively large, heavy bale is formed.

U.S. Pat. No. 4,084,496 discloses a machine with a vertical ram having a platen that moves down in a compaction chamber. This machine requires a feed hopper forwardly of the compaction chamber and is a relatively large and tall machine since the final bale structure is made up of a succession of charge feeds and the bale is on the order of 20 to 50 pounds.

DISCLOSURE OF INVENTION

A method and apparatus for handling compactible articles which includes main housing forming a compaction chamber, with a movable bottom wall for the housing. A retractable chute receives a quantity of articles, preferably a weighed quantity from an overhead scale, and directs them into the compaction chamber via a feed opening. The chute is moved to a retracted position to form a wall portion of the chamber. A magnetic separator on the door removes undesirable magnetically attracted articles from the feed. A vertical ram drives a platen down into the chamber to form a unitary block of interconnected compacted articles that is then moved down into a receptacle below the chamber. For some applications, the block is dropped into a plastic bag held open by being releasably fastened to the inside of the receptacle. The receptacle is removed from below the chamber. The blocks are of a pallet-stackable size and shape for stacking on a pallet for storage and transportion.

BRIEF DESCRIPTION OF DRAWINGS

The details of this invention will be described in connection with the accompanying drawings, in which:

FIG. 1 is a perspective view of apparatus of the present invention with the loading chute shown in the retracted position;

FIG. 2 is a top perspective view of a unitary block of interconnected compacted articles;

FIG. 3 is a top perspective view of the receptacle in a removed position with portions broken away to show the bottom slide construction;

DETAILED DESCRIPTION

Figure 4:
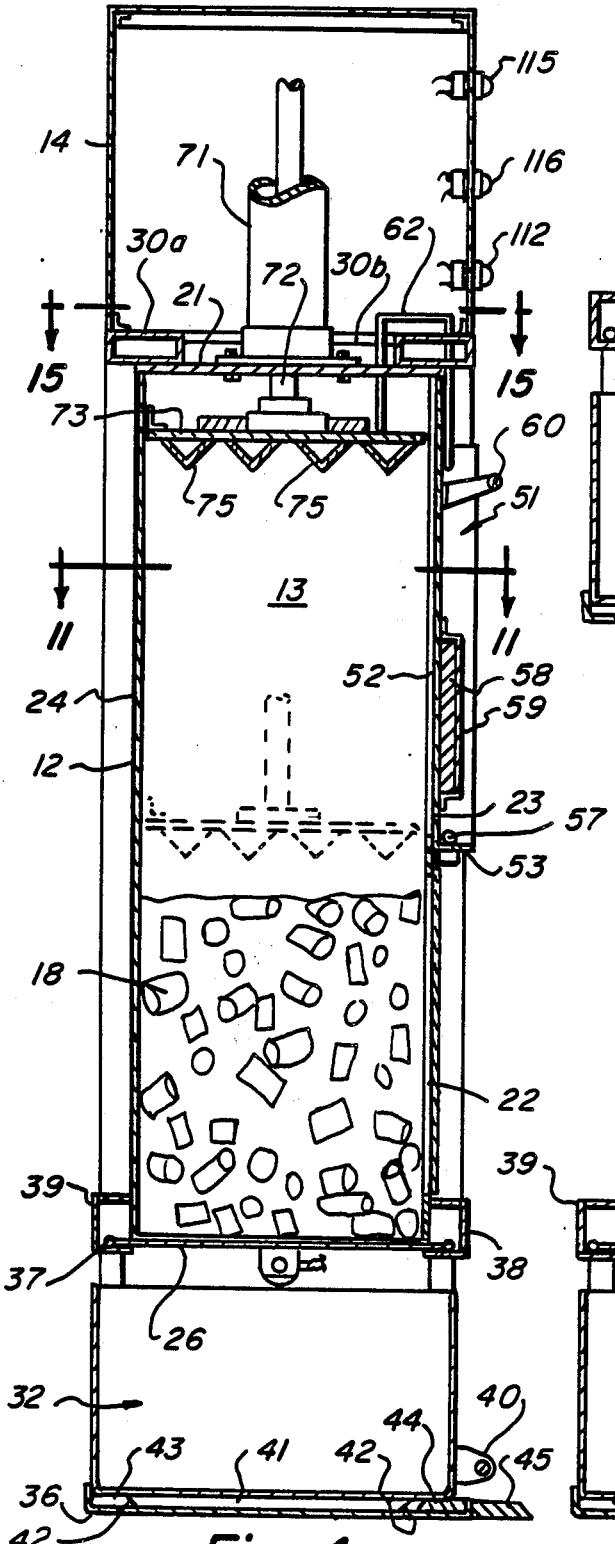
FIG. 4 is a sectional view taken along lines 4—4 of FIG. 1 showing the platen in the up position, and the compaction chamber loaded with articles to be compacted.
Figure 6:
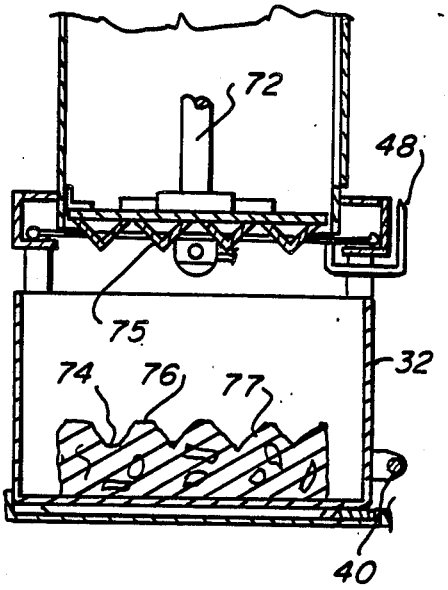
FIG. 6 is a sectional view showing the ram the lowest down position for moving the block downwardly from the chamber and into the receptacle.
Figure 5:
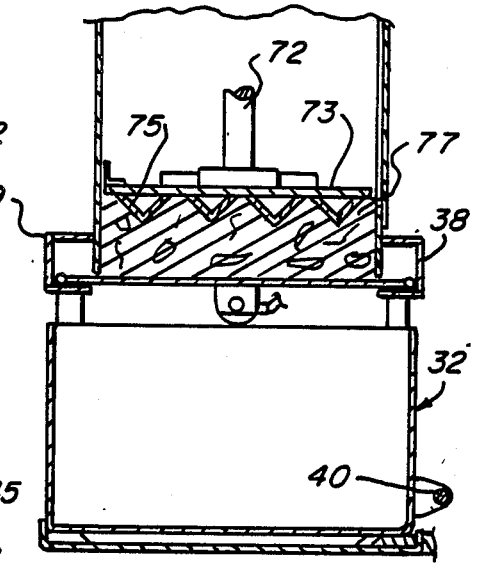
FIG. 5 is a sectional view of a lower portion of the ram showing the ram in a lowered position with the bottom door closed.
Figure 7:
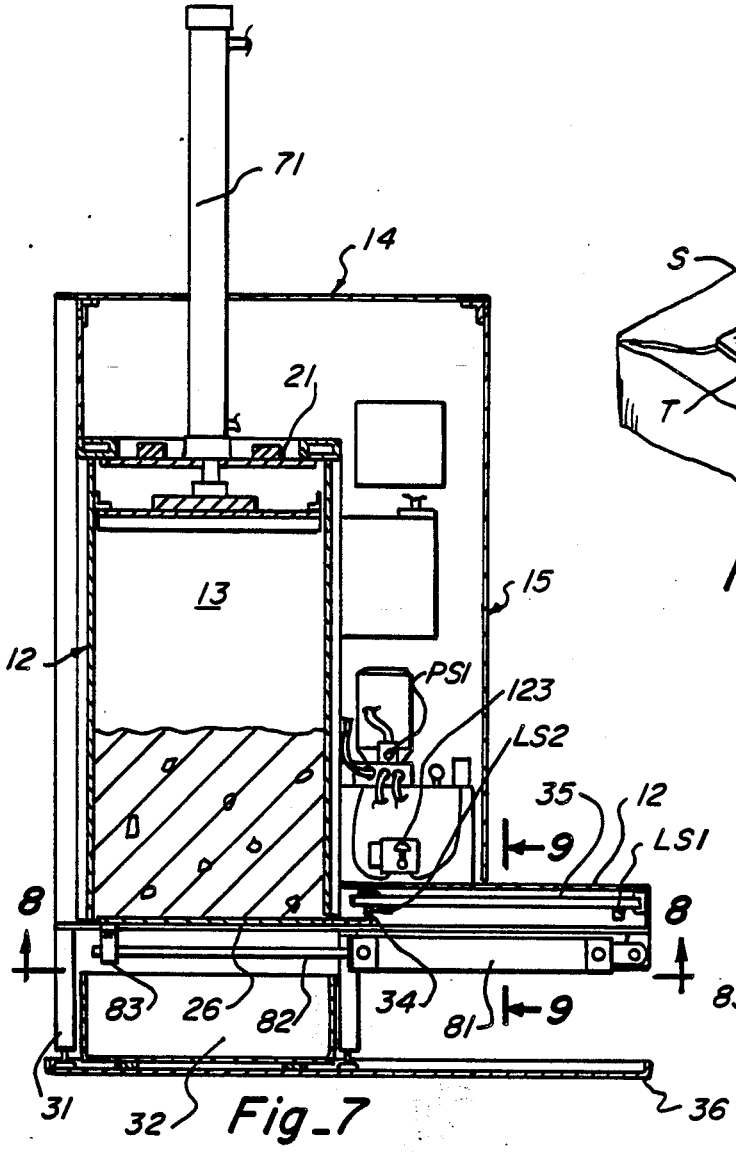
FIG. 7 is a sectional view taken along lines 7—7 of FIG. 1.

Referring now to the drawings, there is shown apparatus including a generally cube-shaped main housing 12 forming the compaction chamber 13, a top auxiliary housing 14 above the main housing and side auxiliary housing 15 along the side of the main housing as well as a side shelf 16 extending beyond the side of the side auxiliary housing 15. The articles to be compacted 18 are shown in the lower portion of the chamber 13.

The main housing 12 includes a top wall 21, a front wall 22 with a feed opening 23, a rear wall 24, a pair of spaced side walls 25, and a movable floor or bottom door 26. These housing walls are held in place by a frame which includes four upright corner members 27; lower transverse connecting members 28 along the sides, front, and rear together with upper transverse connecting members 29 along the sides, front, and rear that are connected at the ends to the corner members 27. These members 27, 28, and 29 are preferably tubular steel, having a rectangular cross-section, and are welded together to form a very strong and rigid framework. The top wall is reinforced by a top frame 30*a* made of tubular steel that is above and extends throughout the periphery of the top wall as well as cross frame members 30*b* transversely thereof to provide adequate strength.

A front right angle member 38 extends down and rearwardly across the front bottom edge of the main housing 12 and side auxiliary housing 15 and the side shelf 16 for the full width of the apparatus. A rear right angle member 39 extends down and forwardly of the rear bottom edge of housings 12 and 13 in a parallel relation to member 38. The bottom door 26 is in the form of a flat plate that has rod-shaped edge portions 37 affixed along the front and rear edges that slide on and are retained by the opposite right angle members 38 and 39 which form a guideway for the bottom door and prevent it from twisting during its sliding movement between open and closed positions. The other end of the bottom door 26 is provided with an upturned flange 34 with an aperture. A guide rod 35 is mounted under the side shelf and extends laterally of the shelf and the guide rod extends through the aperture to also guide the movement of the bottom door and prevent it from twisting. An indicator rod 48 is affixed at one end to the bottom door 26 and extends up in front of the front angle member 38 to indicate to the operator the position of the bottom door.

The main housing 12 is supported on legs 31 which are affixed to the angle members 38 and 39 to support the bottom door 26 a selected distance above the supporting surface to accommodate a receptable 32 being placed under the chamber 13. Side straps 20 are secured between each of the front and rear legs for added strength. The legs are supported on a drip tray 36 with an upturned outer edge that extends under the entire apparatus to catch moisture from the articles being compacted and to permit the apparatus to be washed with a pressure hose or the like.

The receptacle 32 has a handle 40 to facilitate its removal and replacement. A guide and tracking system is provided for the receptacle which includes two sled-like bottom members 41 affixed to the underside of the receptacle and arranged parallel to one another with beveled edges 42 at each end. A rear stop member 43 is mounted between the rear legs and a front stop member 44 extends between the front legs. A front pad 45 is disposed on the supporting surface forwardly of the tray. In this way the legs 31 serve as a guideway for sliding the receptacle into place under the compartment and the bottom members 41 slip down between the front and rear stop members 43 and 44 to locate the receptacle in the proper position under the chamber 13 with the receptacle resting on the stop members.

The main housing 12 has a loading chute 51 operatively associated with the front wall 22. Chute 51 includes a front plate 52 of a non-magnetically attracted material, preferably stainless steel, that closes the feed opening 23 in the front wall 22 when the chute is in a retracted positon. The loading chute 51 further has a bottom flange 53 that turns forwardly, and a pair of end channel portions 54 that are secured along the side edges of the front plate 52 and nest over the upright corner members 27. Channel portions 54 have an outer leg extension 55 which together form the upright structure along the sides of the chute that will retain and direct the articles into the feed opening 23.

Figure 14:
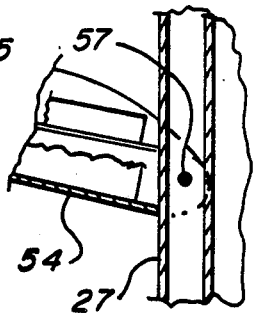
FIG. 14 is a sectional view taken along lines 14—14 of FIG. 13 showing the chute in the open position.
Figure 15:
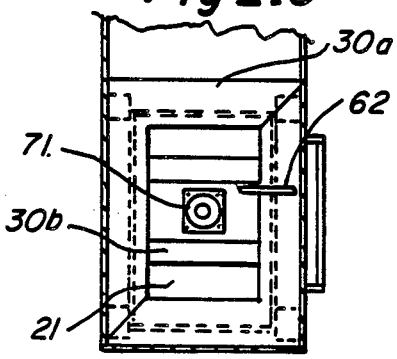
FIG. 15 is a sectional view taken along lines 15—15 of FIG. 4.

The loading chute 51 has a bottom pivot rod 57 extending along the bottom of the front plate and held in a sleeve with end portions that extend through the front corner members 27 about which the chute will pivot to move between retracted and extended positions. In the extended position the bottom of the end channel portions 54 bear against the corner members 27 as best seen in FIG. 14 to hold the chute in the open position. The chute is pivoted less than an 90 degree angle and at an angle of about 80 degrees so it is tilted out an up to direct the articles into the chamber opening. A resilient flap 56, preferably spring metal, is affixed at one end to the inside edge of outer leg extension 55 and extends back against the inside leg of portion 54 to close the channel when the chute is open so the articles are not caught in portion 54. The flap 56 is compressed between the corner member 27 and leg portion 55 in the retracted position for the chute.

A permanent magnet 58 is mounted outside the front plate 52 and held thereto by a holder 59 to attract magnetically attracted articles to the front plate to separate magnetically attracted articles from being delivered into the compaction chamber. The loading chute further has a handle 60 on top for manually pulling the chute to the open position shown in FIG. 14. An inverted U-shaped rod 62 has an outer leg that extends through an aperture in member 30*a* and down the front of the chute and an inner leg that extends through an aperture in the top wall 21 into the chamber. Rod 62 will lock the chute in the closed position until the ram is moved into its up position as a safety feature.

The front wall 22 is further provided with a site gage which includes a vertical slot 64 in the front wall 22 that is covered by a transparent sheet material so the user is able to see inside the chamber and there is also provided a horizontal elevation site line 65.

A double-acting hydraulic ram 71 is mounted upright on the top wall 21. Ram 71 has the vertically movable ram rod 72 that moves a platen 73. The platen has a flat plate that carries a plurality of V-shaped or right-angle members 75 that are arranged side by side and secured to the bottom face of the flat plate so as to form corrugations comprised of a series of valleys 74 and peaks 76 in the top face of the block along the length thereof to increase the strength of the block 77.

A double-acting hydraulic cylinder 81 has a movable cylinder rod 82 that connects to a flange 83 extending down from the bottom door 26 to move the bottom door between a closed position as shown and a retracted position in which the formed block may be pushed from the chamber. The door cylinder 81 is shown as mounted under the side auxiliary housing 15 and shelf 16 below rod 35.

A device for supporting and weighing the articles 18 before compaction includes a U-shaped support bracket portion 85 that slides down around the ram cylinder 71 having a cross bar 86 with a pair of rollers 87 on the bar 86 bear against the side of cylinder 71 when disposed at a slight downward tilt. A pair of converging arm portions 88 that extend out from portion 85 over the open chute 51. A weighing scale 89 is supported at the end of the arm portions 88. A hook 91 on the end of the weighing scale 89 supports a plastic bag 92 full of articles 18 to be compacted. In use the chute 51 is moved to the open position and the bag 92 is slit across the bottom so that the articles are discharged into the open chute 51.

Figure 20:
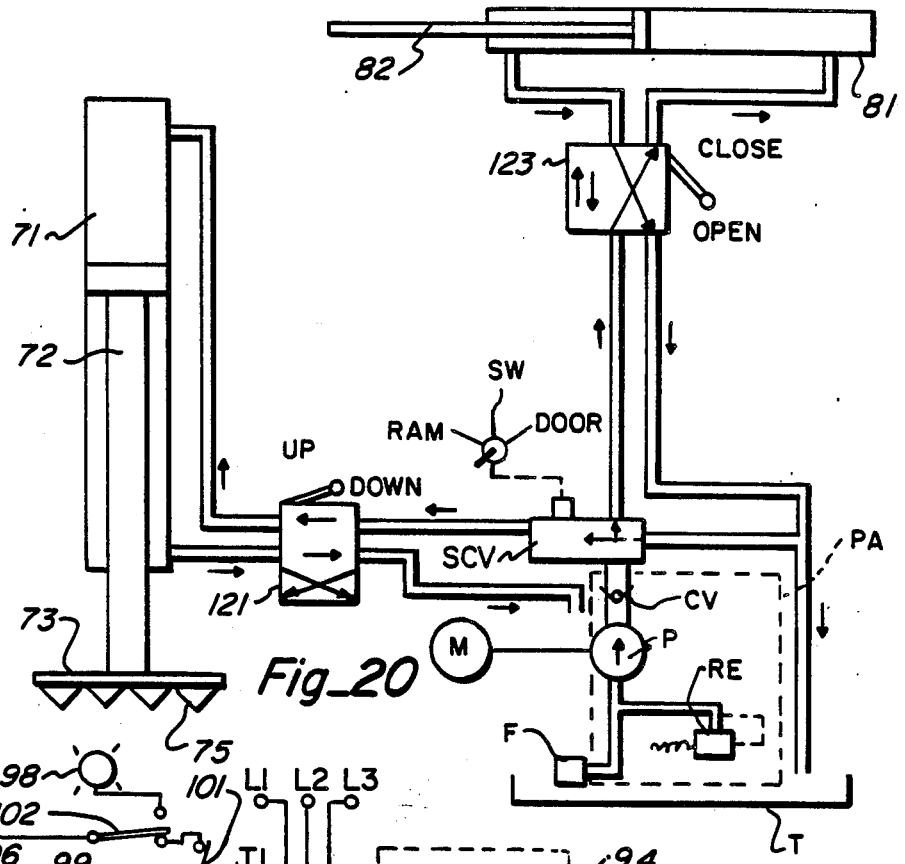
FIG. 20 is a schematic diagram of the hydraulic system and controls for the vertical ram and door cylinder.
Figure 21:
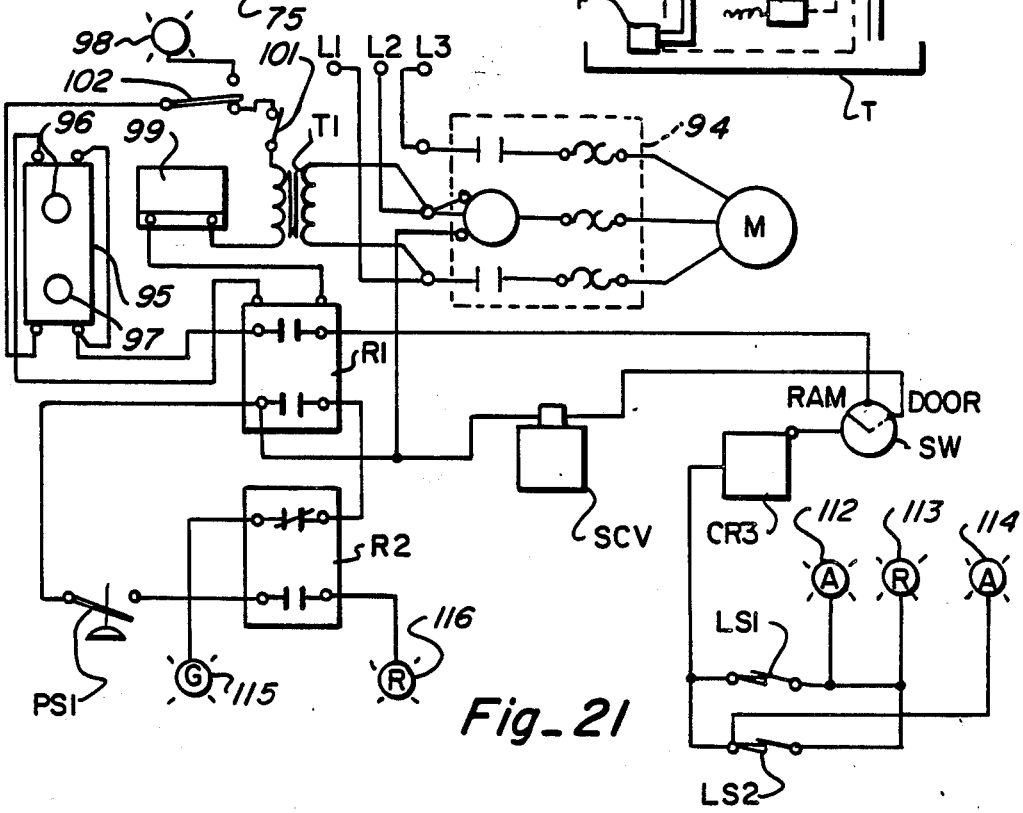
FIG. 21 is a schematic diagram of the control for the motor and the circuit for the control levers operating the platen and bottom door and for operating the indicator lights.

Referring now to FIGS. 20 and 21 the motive power for driving the platen ram 71 and door cylinder 81 is provided by a motor M and pump assembly PA. The pump assembly includes a pump P, and relief valve RE, filter F and tank T arranged in a conventional manner.

It is understood that the motor M and pump assembly PA shown mounted in the side auxiliary housing could be replaced by any hydraulic fluid power pack. For example many grocery stores already have such power packs available in their cardboard compactors.

The drive motot M is shown in FIG. 21 to be a three-phase motor. Power lines L1, L2, L3 supply three-phase power through a conventional across-the-line magnetic starter indicated by a block 94 and of a control box 95 having a start button 96 and a stop button 97. When the start button 96 is pushed the contacts in block 94 close to apply line power to the motor M and when the stop button 97 is pushed the contacts open and the motor M stops.

A step-down transformer T1 is connected across lines L1 and L2. An emergency stop switch 101, chute safety switch 102, and control box 95 are connected in series between line L1 and a control relay R1 which in turn controls the power to the selector switch SW. A chute ajar light 98 indicates when the chute is ajar. A chute safety switch 102 is located to one side of the front corner member with the contact closed when the chute is closed. A timer 99 is connected in the line to drop the power to the relay R1 to shut down the machine after a selected interval of time, preferably 90 seconds. The power is connected from switch SW to the solenoid energized control valve SCV which will deliver fluid to either the door cylinder 81 or the platen ram 71 depending on the setting of the selector switch SW.

Another circuit from the selector switch SW has in series control relay CR3, two limit switches LS1, LS2 to lights that will indicate the door position is either closed, ajar or open by amber light 112, red light 113, and amber light 114 respectively.

A further circuit connected to relay R1 includes a high limit pressure switch PS1 that is closed when the platen has compressed the articles into a block and a preselected maximum pressure has been reached, preferably 2400 psi. A second relay R2 has a light 115 indicating power is on and proceed and a red light 116 that indicates maximum pressure has been attained and the platen should be raised to the site line 65.

Referring now to FIG. 20, the motor M drives a pump P which pumps fluid through a check valve CV to the solenoid operated two-way control valve SCV which controls the fluid flow to both the door cylinder 81 and the ram 71 depending on the setting of the selector switch SW. A manual four-way control valve 121 for the ram has a lever on the face of the panel with an up position and a down position to determine which direction the fluid flows to and from the ram 71. A four-way manual control valve 123 for the door cylinder has a lever with a close setting and an open setting which determines which direction the fluid flows through the door cylinder 81. A tank T receives the return flow from the ram and cylinder and supplies fluid to the pump P.

In a full sequence of operation, the chute 51 is opened and a bag 92 of articles is mounted on the scale 89 above the open chute. The weight of the bag is recorded. The bottom of the bag is slit so that the articles 18 are discharged onto the chute. Magnetically attracted articles such as iron become attracted to the front plate 52 and the articles 18 to be compacted are discharged into the chamber. The undesireable magnetically attracted articles are removed. The chute is closed so that any articles remaining on the chute are discharged into the compaction chamber.

The start button 96 is pushed, and it starts the motor M which drives the hydraulic pump P. The instrument light 115 indicates when to pull the ram lever of valve 121 and hold it down until maximum pressure is reached. A red light 116 will then come on and the light 115 goes off at maximum pressure, and this tells the operator to raise the platen to the mark on the line 65. This releases the pressure on the block 77. The operator then turns the selector switch SW to the door position. The bottom door is moved by moving the control lever of valve 123 to the open position. The selector switch SW is moved to the ram position. The control lever of valve 121 is moved to the down position to eject the block. The control lever of valve 121 is moved to the up position and the platen raised to line 65. The selector switch SW is moved back to the door position. The control lever of valve 123 is moved to the close position to close the door. The selector switch SW is moved to the ram position. Finally, the lever of valve 121 is moved to raise the platen to the top position. The receptacle is removed from under the apparatus and the block 77 is then placed on the shelf 16.

The approximate weight of a block 77 of aluminum cans is 12 pounds. The dimension of the block 77 is about 23.5 inches in length, 15 inches in width, and 6 inches in height. The depth of the valley of the corrugations is one inch. This is a relatively small size and small thickness as compared to prior art blocks and enables the machine to be comparatively short in height and depth and ideally suited for grocery and convenience store applications. It is noted there is no feed hopper or conveyor required at the front and the machine does not take up a lot of floor space (approximately 9 $ft^2$).

Figure 10:
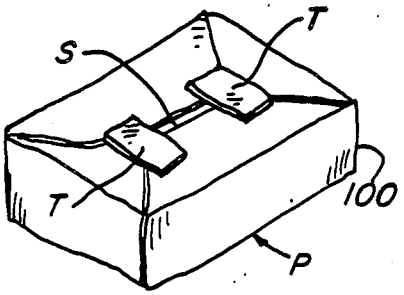
FIG. 10 is a perspective view of a packaged block.
Figure 9:
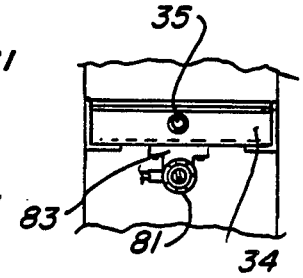
FIG. 9 is a sectional view taken along lines 9—9 of FIG. 7.
Figure 8:
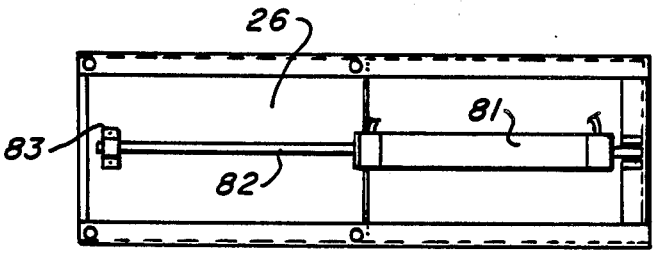
FIG. 8 is a sectional view taken along lines 8—8 of FIG. 7.
Figure 11:
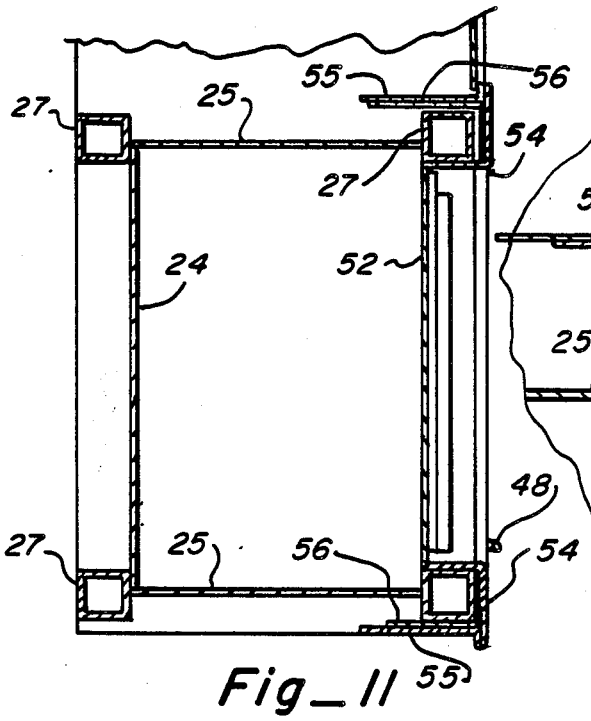
FIG. 11 is a sectional view taken along lines 11—11 of FIG. 4.
Figure 12:
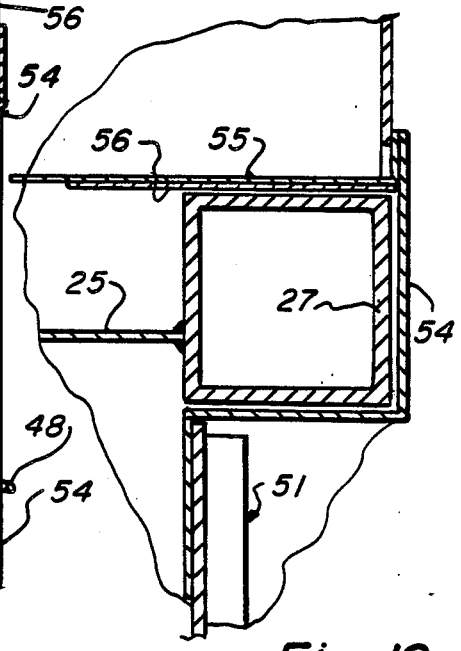
FIG. 12 is an enlarged cross-sectional view of one of the corner/posts shown in FIG. 11.
Figure 13:
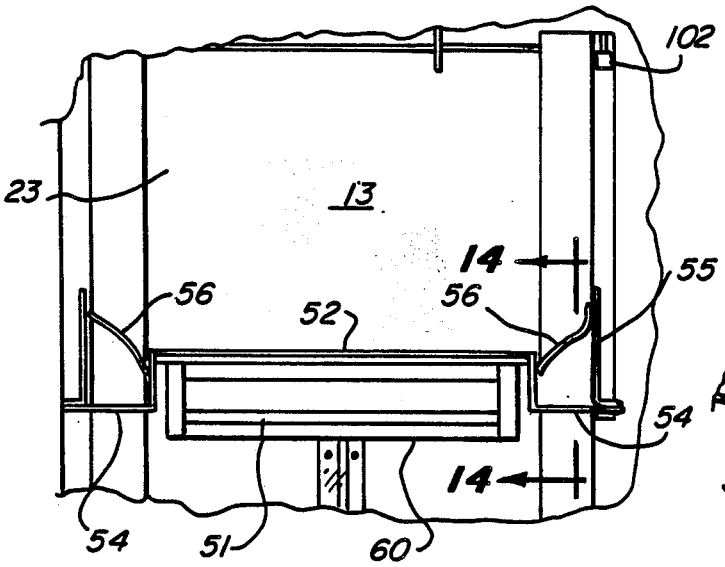
FIG. 13 is a front elevation view of the chute in the open position.

When it is desired to package the block, a rubberband B is used to hold a plastic bag 100 in an open receiving position in the receptacle 32. After the receptacle is removed from under the chamber the rubberband B is removed and the ends of the bag are folded leaving a slot S in the top as seen in FIG. 10. Two strips of tape T are placed over the folded ends of the bags and these form handle grips for lifting the package P.

Figure 17:
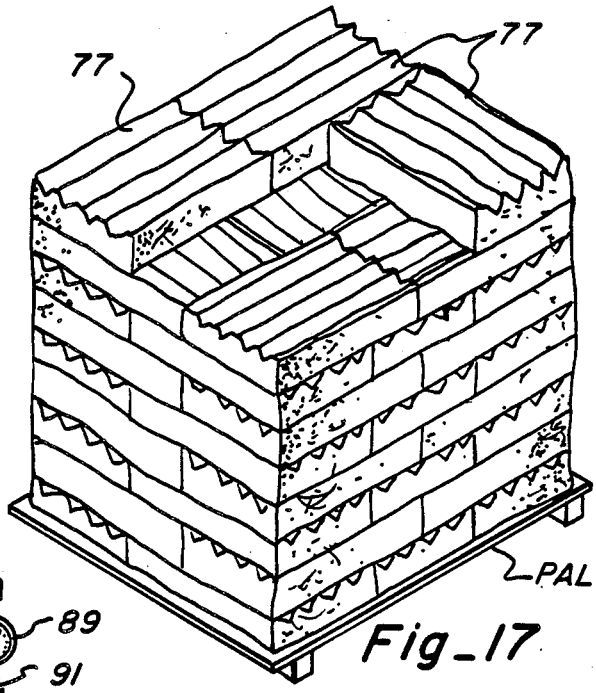
FIG. 17 is a top perspective view of a plurality of the blocks that are cross-stacked on a pallet.
Figure 16:
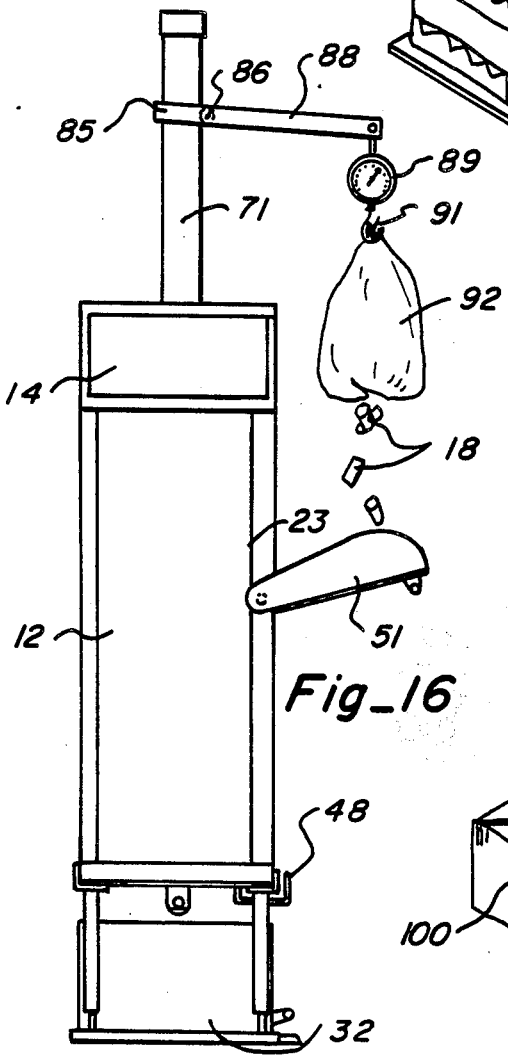
FIG. 16 is a side elevation view of the apparatus showing articles being loaded into the chute.
Figure 18:
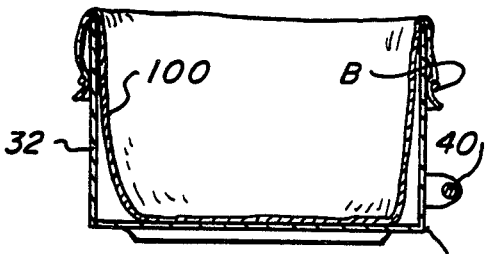
FIG. 18 is a sectional view showing the bag held in the receptacle.

The blocks 77 are of a pallet stackable size as is shown in FIG. 17. A conventional pallet of 48 inches by 40 inches accomodates a layer of three blocks 77 arranged side by side and two blocks 77 arranged end to end. The next larger alternates so that the two end to end blocks rest on the lower three side by side blocks. This is known as cross-stacking in the palletizing trade. The palletized load typically would be six (6) feet in height, and for aluminum cans would be above 750 pounds.

Figure 19:
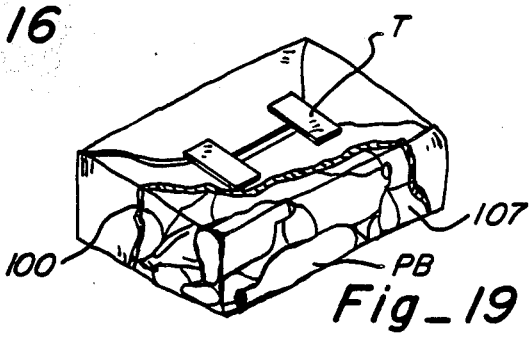
FIG. 19 is a perspective view of a block of plastic bottles in a package.

While the apparatus is particlulary suited for compacting aluminum cans it has been found to be suitable for compacting recyclable plastic bottles. Referring now to FIG. 19 there is shown a block 107 made up of a plurality of interconnected compressed plastic bottles PB. While these compacted bottles do interconnect, the same package of plastic bag 100 and tape T is preferred to hold the block together for stacking and shipping purposes.

Although the present invention has been described with a certain degree of particularity, it is understood that the present disclosure has been made by way of example and that changes in details of structure may be made without departing from the spirit thereof.

What is claimed is:

1. In apparatus for handling compactible articles, the combination comprising:

a housing forming a compaction chamber, said housing having a bottom door movable between a closed position and an open position and having a feed opening through which compactible articles are passed to be collected in said chamber, a retractable batch loading chute into which a batch of articles are discharged at the same time when in an open extended position arranged for directing said batch of articles through said feed opening into said chamber and movable to a retracted position to form a wall portion of said chamber and to close said feed opening, said chute having a magnetic means to cause magnetically attracted articles to adhere thereto to prevent said magnetically attracted articles delivered into said chute in the open position from being passed into said chamber, first drive means having a platen that is moved between extended and retracted positions in said compaction chamber, said platen being moved in a single unidirectional compaction stroke to compact said collected articles in said chamber together into a unitary block of mechanically interconnected compacted articles and then further extended in the same direction after said compaction stroke to move said block from said chamber, and second drive means connected to said bottom door to move said bottom wall between a closed position for compaction and a retracted position for the discharge of said block from said chamber.

2. In apparatus for handling compactible articles, the combination comprising:

a housing forming a compaction chamber, said housing having a bottom door movable between a closed position and an open position and having a feed opening through which compactible articles are passed to be collected in said chamber, a retractable batch loading chute into which a batch of articles are discharged at the same time when in an open extended position arranged for directing said batch of articles through said feed opening into said chamber and movable to a retracted position to form a wall portion of said chamber and to close said feed opening, first drive means having a platen that is moved between extended and retracted positions in said compaction chamber, said platen being moved in a single unidirectional compaction stroke to compact said collected articles in said chamber together into a unitary block of mechanically interconnected compacted articles and then further extended in the same direction after said compaction stroke to move said block from said chamber, second drive means connected to said bottom door to move said bottom wall between a closed position for compaction and a retracted position for the discharge of said block from said chamber, and guide means to support said bottom door for sliding movement between said open and closed positions without substantial twisting during said movement, said guide means including a pair of oppositely disposed right angle members having portions extending under and along the front and rear edges of the door and a flange affixed to a side of the door, said side flange having an aperture through which a fixed guide rod extends, said guide rod extending in the direction of movement of said door.

3. In apparatus for handling compactible articles, the combination comprising:

a housing forming a compaction chamber, said housing having a bottom door movable between a closed position and an open position and having a feed opening through which compactible articles are passed to be collected in said chamber, a retractable batch loading chute into which a batch of articles are discharged at the same time when in an open extended position arranged for directing said batch of articles through said feed opening into said chamber and movable to a retracted position to form a wall portion of said chamber against which said articles are pressed during compaction in said chamber and to close said feed opening, first drive means having a platen that is moved between extended and retracted positions in said compaction chamber, said platen being moved in a single unidirectional compaction stroke to compact said collected articles in said chamber together into a unitary block of mechanically interconnected compacted articles and then further extended in the same direction after said compaction stroke to move said block from said chamber, second drive means connected to said bottom door to move said bottom wall between a closed position for compaction and a retracted position for the discharge of said block from said chamber, said chute being mounted to pivot at a bottom edge portion with a top edge portion swinging out and away from said housing to be disposed at a forward and downward angle in the open position, said loading chute including a non-magnetically attracted plate that forms said wall portion of said chamber in said retracted position, and a magnet externally of said plate to cause magnetically attracted articles to adhere to said plate to prevent such articles from being passed into said chamber.

4. Apparatus as set forth in claim 3 wherein said chute has upstanding side wall portions that project out from the opposite side edges of said plate to form a channel-shaped structure to confine the articles deposited thereon, said side wall portions are recessed back into said housing in the retracted position.

5. In apparatus for handling compactible articles, the combination comprising:

a housing forming a compaction chamber, said housing having a bottom door movable between a closed position and an open position and having a feed opening through which compactible articles are passed to be collected in said chamber, a retractable batch loading chute into which a batch of articles are discharged at the same time when in an open extended position arranged for directing said batch of articles through said feed opening into said chamber and movable to a retracted position to form a wall portion of said chamber against which said articles are pressed during compaction in said chamber and to close said feed opening, first drive means having a platen that is moved between extended and retracted positions in said compaction chamber, said platen being moved in a single unidirectional compaction stroke to compact said collected articles in said chamber together into a unitary block of mechanically interconnected compacted articles and then further extended in the same direction after said compaction stroke to move said block from said chamber, second drive means connected to said bottom door to move said bottom wall between a closed position for compaction and a retracted position for the discharge of said block from said chamber, said housing having a covered slot below said loading chute to view the location of said platen in said chamber and an indicator line to indicate to the user when to raise the platen.

* * * * *